US006478065B1

(12) United States Patent
Haberstroh et al.

(10) Patent No.: US 6,478,065 B1
(45) Date of Patent: Nov. 12, 2002

(54) STRAPPING MACHINE WITH IMPROVED ACCESS DOORS

(75) Inventors: James A. Haberstroh, Vernon Hills, IL (US); Darryl M. Devine, Huntley, IL (US)

(73) Assignee: Illinois Tool Works Inc., Glenview, IL (US)

( * ) Notice: Subject to any disclaimer, the term of this patent is extended or adjusted under 35 U.S.C. 154(b) by 160 days.

(21) Appl. No.: 09/603,425

(22) Filed: Jun. 26, 2000

(51) Int. Cl.[7] ..... B65B 13/18; B65B 13/02

(52) U.S. Cl. ..... 156/443; 156/580; 53/589; 100/2; 100/26

(58) Field of Search ..... 156/443, 535, 156/580, 73.5, 446; 53/589; 100/2, 32, 25, 26

(56) References Cited

U.S. PATENT DOCUMENTS

| | | | | |
|---|---|---|---|---|
| 4,850,179 A | * | 7/1989 | Takami | 53/589 |
| 5,287,802 A | * | 2/1994 | Pearson | 100/4 |
| 5,640,899 A | | 6/1997 | Bell et al. | 100/2 |
| 5,657,612 A | | 8/1997 | Renz et al. | 53/399 |
| 5,718,167 A | | 2/1998 | Renz et al. | 100/29 |
| 5,746,882 A | | 5/1998 | Bell et al. | 156/580 |
| 6,039,286 A | | 3/2000 | Abrams et al. | 242/564.4 |
| 6,155,032 A | * | 12/2000 | Lai | 53/589 |

FOREIGN PATENT DOCUMENTS

JP 06247408 A * 6/1994

* cited by examiner

*Primary Examiner*—Richard Crispino
*Assistant Examiner*—Sue A. Purvis
(74) *Attorney, Agent, or Firm*—Donald J. Breh; Mark W. Croll; Lisa M. Soltis

(57) ABSTRACT

A strap path guide cover, comprising part of the outer housing cover of a strapping machine, is pivotally mounted such that it may be rotated away from the housing of the strapping machine to expose a strap path. The cover defines parts of numerous elements of the strap path created through the head of the strapping machine. The cover defines a number of openings for cooperatively engaging corresponding alignment pins extending from the head, such that alignment of the cover, and thus the strap path, is made accurately and easily. The cover may be rotated down for cleaning of jams and debris from the strap path, and may be rotated to a first position, aligning the strap path, for a rapid return to use. The present invention further defines an upper strap path guide cover which also pivotally opens to allow for cleaning of the upper path and pivotally closes in alignment.

9 Claims, 3 Drawing Sheets

STRAPPING MACHINE WITH IMPROVED ACCESS DOORS

FIELD OF THE INVENTION

The present invention concerns a novel assembly which provides access to the strap path of a strapping machine while providing elements of the components of the strap path.

BACKGROUND OF THE INVENTION

Strapping machines are complex assemblies of parts which combine to move strap material from a reel to a head where the material is placed about an object to be strapped. Because of the complexity of these strapping machines, the debris which is produced in the strapping process, and the speed with which the strapping material may travel though the machine, access to the strap path for maintenance and cleaning is often required.

In strap machines used presently, access to the strap path has generally been achieved through the difficult disassembly of housing panels and removal or displacement of key strap path components. The machine may then be cleared of strap debris and jams. The components must then be carefully aligned and reassembled prior to resuming strapping. Such a disassembly and reassembly is generally required at each incident of jamming of the strapping machine and the strapping machine may need to be cleaned of debris often, depending on the material used in the strapping process and the amount of strapping being done. Poor alignment of the strap path components may lead to further jams and more disassembly of the strapping machine. In general, due to the complexities of the strapping machines, assembly and disassembly has been very time consuming and exacting, forcing great delays in the strapping process.

U.S. Pat. No. 5,746,882 to Bell et al., discloses one arrangement in which a strap path door is configured for pivotal movement to permit access to the various components within the strap path (e.g., the strapping head). Although the access path apparatus disclosed in Bell et al. works well for its intended purpose, the access door is mounted directly to a structural member (i.e., the strapping head) and as such it requires that a hinge collar or collars be formed as part of the structure of the strapping head. Because this part of the strapping head structure is a cast or otherwise costly (e.g., highly machined) component, the hinge assembly is, likewise a costly assembly.

It would be preferable to have a strapping machine where the strap path may be accessed and cleared without the disassembly of panels and components, in a cost effective manner. Further, it would be desirable to be able to clear debris from a strapping machine without the need to disassemble major components of the strap path or remove housing panels.

SUMMARY OF THE INVENTION

In accordance with the present invention, a strapping machine, allowing easy access to a strap path is provided. The strapping machine comprises a head defining a strap path and a cover, pivotally attached to the strapping machine. The cover is attached such that in a first closed position the cover comprises a protective exterior element of the strapping machine and provides the outer guiding constituent for the strap path elements, and in a second, pivoted open position, the cover allows access to the strap path.

In the preferred embodiment of the present invention, the strap path cover is hinged to an outer, non-structural panel of the strapping machine housing and may be rotated down so as to allow access to the strap path. Because the outer, non-structural panel is not a structural member of the machine, the hinge used to mount the door to the machine need not be a cast or like highly machined or engineered part. Rather, the hinge can be made from relatively common components, such as a piano hinge or the like.

The strap path cover further provides the outer elements of a number of the strap path components. As the cover is hinged, it is easily rotated down to expose parts of the strap path and then rotated back to its initial position to align the outer elements of the strap path constituents so that the strapping process may resume. The strapping machine of the present invention further comprises an upper strap guide having an upper guide strap cover that is hinged and may be pivoted down to clear the strap path defined therein. The upper guide cover, in its first default position, provides elements of the upper strap path.

In the preferred embodiment of the present invention, the strap path cover defines a number of openings through which such elements as feed wheel axles, strap gate and winder parts and alignment pins may protrude. In this manner, the outer feed wheel guides, the outer winder wall and the strap gate guide may be formed by the interior wall of the strap path cover. The strap path cover may then be pivoted down from the strap path, dividing elements of the feed wheels, winder and strap gate so that strapping material or debris may be removed from the path and from within those strap path elements. Further, maintenance on strap path elements may be done while the strap path cover is in an open position. When the cover is pivoted back to its first position the various elements of the strap path, that protrude though the openings defined in the cover, and the alignment pins allow the path cover and the elements defined by the cover to be returned immediately to proper alignment. The upper path guide may also be pivoted, independently from the strap path cover, to allow access to the upper strap path for clearing of debris and jams. The upper guide defines openings for upper path elements and alignment pins allowing the path to be returned to alignment by pivoting the guide back to its first position.

A more detailed explanation of the invention is provided in the following description and claims and is illustrated in the accompanying drawings.

DETAILED DESCRIPTION OF THE ILLUSTRATIVE EMBODIMENT

Figure 1:
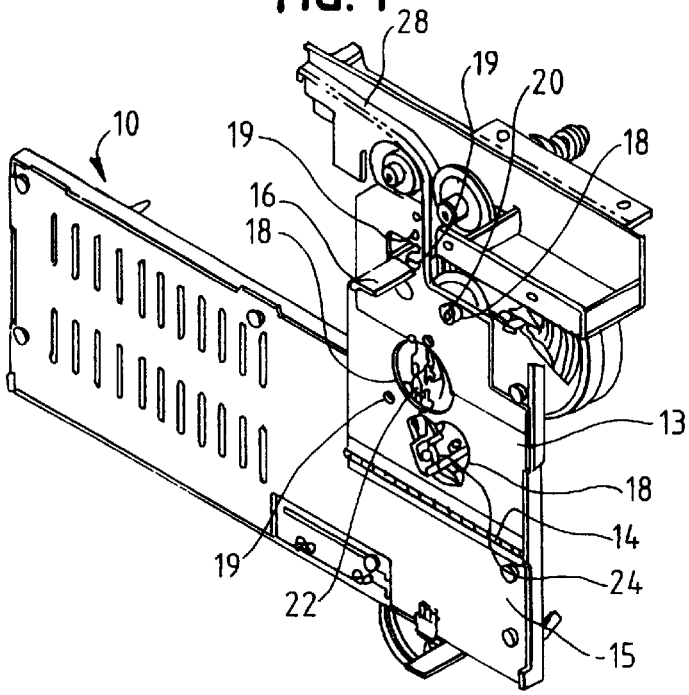
FIG. 1 is a perspective view of a portion of a strapping machine defining a strap path, covered by the strap path cover of the present invention, further showing an upper strap guide, having an upper guide cover.

Referring to the drawings, FIG. 1 shows a strapping machine 10 having a strap path accumulator door 12, in a first position, rotatably connected to the strapping machine 10 by a hinge 14, and a pivotal locking element or lever 16. Door 12 defines a number of openings 18 through which portions of elements such as feed wheel axle 20, winder end 22 and strap gate element 24 may protrude. Further, door 12 defines alignment openings 19 through which alignment pins 26 (FIGS. 2, 3 and 4) may protrude. It can be seen that the interior wall 13 (FIG. 2) of accumulator door 12, when rotated to a closed position, comprises end elements for various strap path components. The end elements so defined provide guidance, or a path, for strapping material flowing through strapping head 11 of strapping machine 10. An upper strap guide cover 28 is also shown in FIG. 1 and will be explained in greater detail below.

The door 12 is mounted to a non-structural portion of the strapping machine 10. In a current embodiment, the door is mounted to the take-up box cover 15. Unlike known machines in which the access door is mounted to a structural member, such as the strapping head, the present non-structural mounting arrangement (e.g., to the take-up box door 15) of the door 12 permits the use of less costly, commonly available hinges, such as the illustrated piano hinge 14.

The more costly cast-in-place and or machined hinges provided the necessary alignment of the access door 12 over the strapping head, by the skilled assembly of the hinge in conjunction with the relatively small tolerances of casting and/or machining. The present access door 12 likewise provides this necessary alignment over the head 11 by the use of alignment pins 26 extending outwardly from the head 11 that engage or extend into openings 19 in the door.

Figure 2:
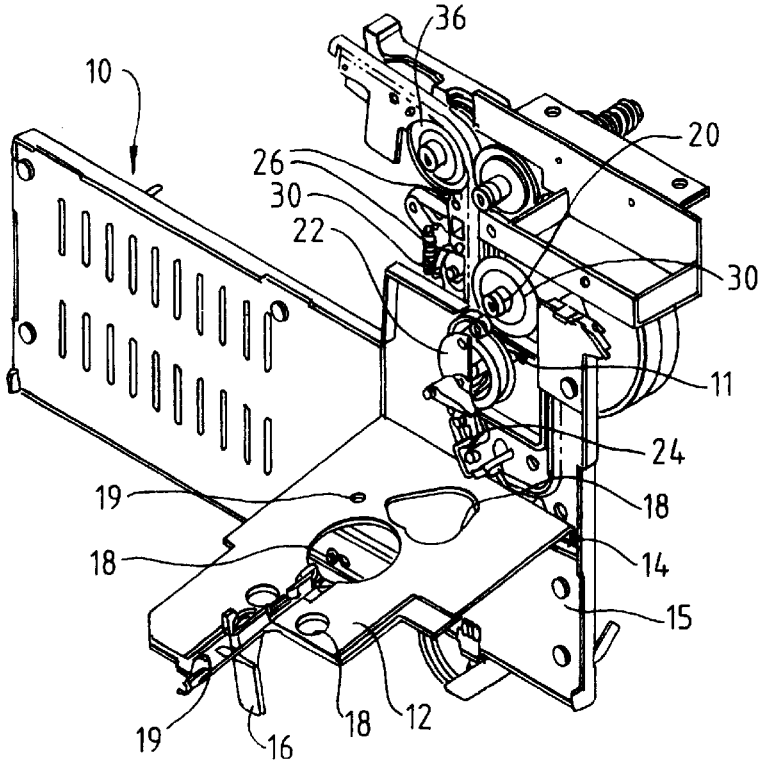
FIG. 2 is a second perspective view of a the strapping machine of FIG. 1, with the strap path cover in a second rotated down position.

FIG. 2 shows the strapping machine of FIG. 1, having strap path accumulator door 12 in an open, strap path accessible, position. It may be seen that lever 16 has been pivoted down to release door 12 so that it may be rotated down on hinge 14. With door 12 open, it can be seen, particularly in FIGS. 2, 3 and 4, that such elements as the feed wheels 30, winder 32 and strap gate 34 (FIGS. 1 and 2) are exposed by the removal of door 12. Any debris or strapping material is easily removed while those elements are uncovered such that the interior of the strap path through those elements is exposed.

Figure 3:
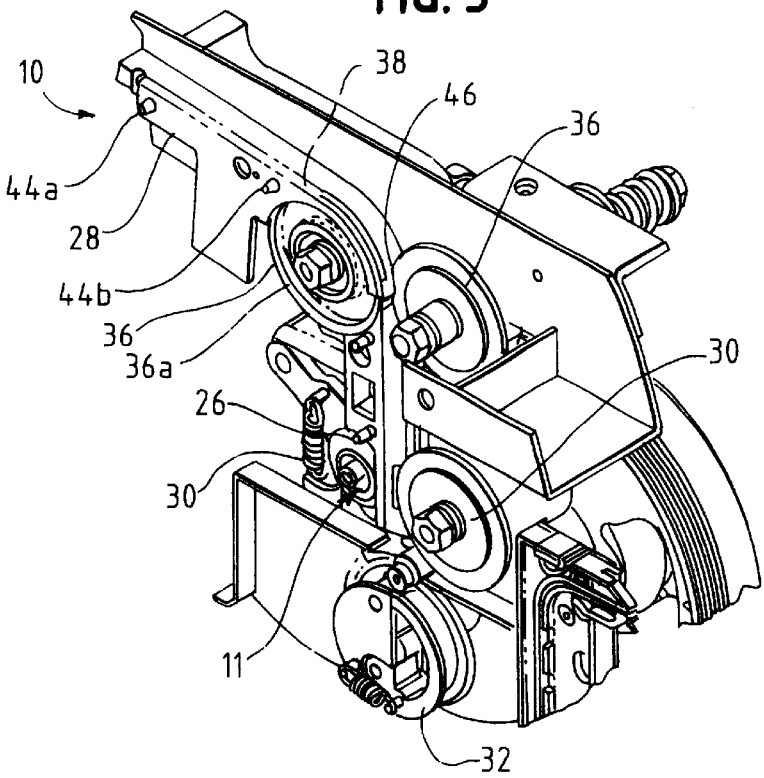
FIG. 3 is a perspective view of an upper strap guide with a strap cover in a first default position.
Figure 4:
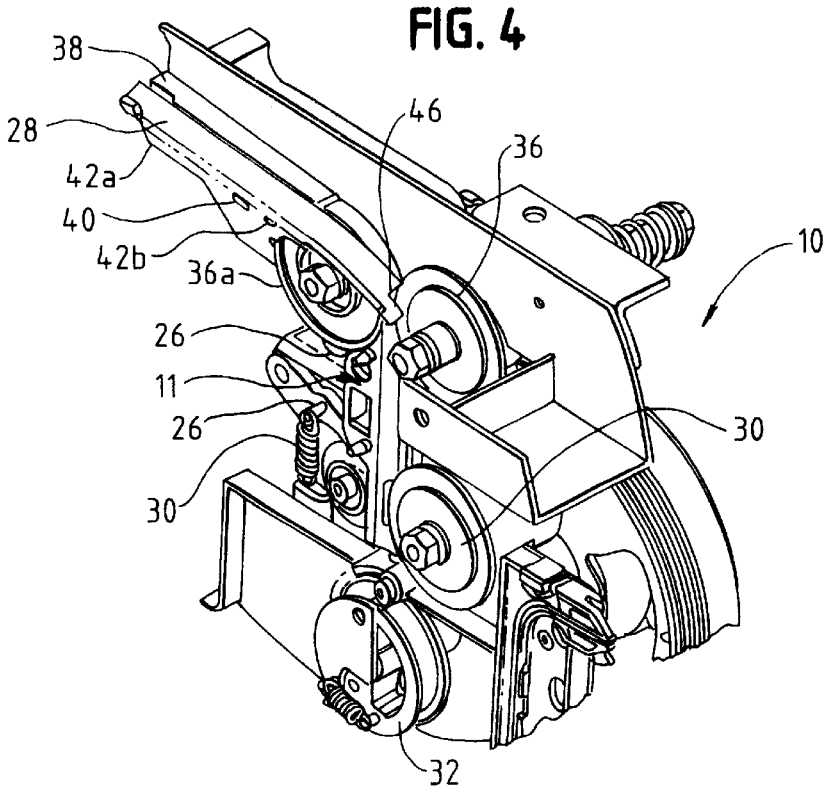
FIG. 4 is a second perspective view of the upper strap guide of FIG. 3 with a strap cover pivoted to a second position.

Referring to FIGS. 3 and 4, it may be further seen that an upper strap guide 28 is provided covering one of the take up wheels 36 and the upper strap path 38. Strap path guide 28 is hinged so that it may be pivoted down (FIG. 4) to expose the strap path 38 through take-up wheel 36. Further, strap guide 28 defines a number of openings including an opening 40 for a spring (not shown) and openings 42*a* and 42*b* for aligning pins 44*a* and 44*b*, respectively, and a slot 46 through which a rim of take up wheel 36 may protrude. Openings 42*a* and 42*b* provide a means for properly aligning guide 28 such that the strap path defined by take up wheel 36 and guide 28 may operate properly.

Figure 5:
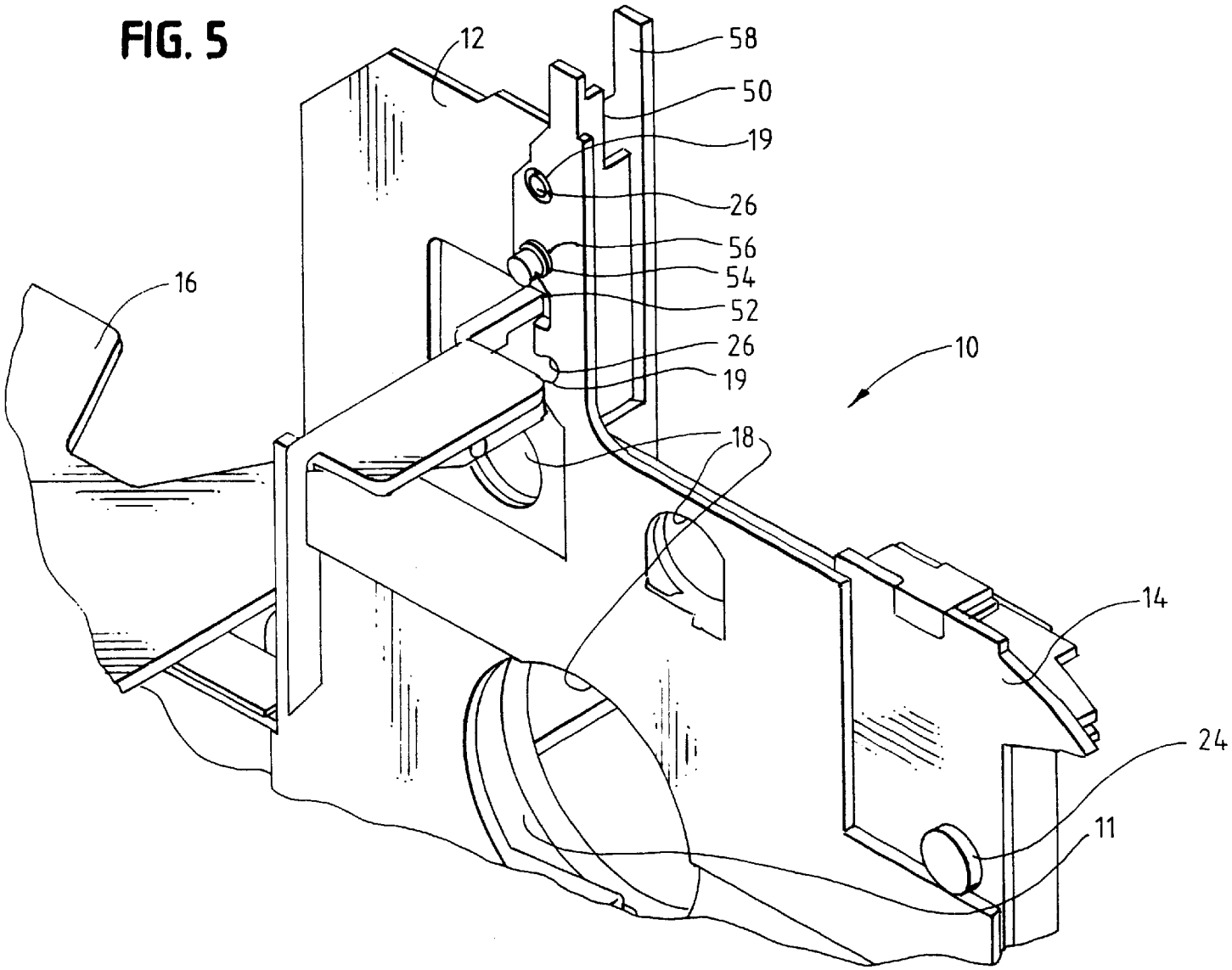
FIG. 5 is a perspective view of the strapping machine of FIG. 1, partially broken away to reveal a strap path guide.

FIG. 5 reveals a floating strap guide 50 moveably attached to the strap accumulator door 12 by a loose pin 52, a screw 54 and washer 56. A fixed strap guide 58, is attached to head 11 by tapered alignment pins 26, and creates, in association with floating strap guide 50, an integral part of the strap path. Alignment openings 19, in floating guide 50, position floating guide 50 in correct alignment with fixed guide 58. Floating guide 50, as a result of its relatively loose attachment to door 12 is free to align itself on tapered alignment pins 26, when door 12 is returned to its first, operating position. The ability of guide 50 to float and align itself on alignment pins 26 assures accurate positioning of the floating guide 50 upon the closing of door 12, such that the strap path is properly formed.

In the operation of strapping machine 10, when it is found that a jam has occurred or when a scheduled cleaning is due, strapping machine 10 may be stopped and lever 16 may be depressed to open door 12. Strap path accumulator door 12 may then be rotated down, on hinge 14, revealing the strap path of strapping machine 10. The rotation down of door 12 causes the removal of end elements, which are part of door 12, of various strap path components and thus, allows access to the strap path. Access to the strap path allows the user to clear debris and loose strap from the strap path and allows for general maintenance, replacement of worn parts and lubrication of the elements of the strap path. When the strap path has been cleared and/or the elements of the strap path have been replaced, maintained or lubricated, door 12 may be pivoted up and locked back into place by lever 16. Because the accumulator door 12 is rotatably attached by hinge 14, in the preferred embodiment, the elements of the strap path formed on door 12 and mounted on door 12 are returned aligned with the fixed parts of the strap path. Alignment is assured by engagement (insertion) of the pins 26 with or through the openings 19. The tapered configuration or shape of the pins 26 (as seen in FIGS. 3 and 4) facilitates proper centering of the openings 19 over the pins 26 as the door 12 is pivoted or rotated closed. The strapping process may be resumed immediately upon the closing of door 12. Clearance and maintenance of upper strap guide 28, may also be accomplished in a similar manner with similar results.

As a further improvement, made by the present invention, it is to be noted that hinged door 12 which provides end elements of the strap path, also provides access to the accumulator box (not shown) of strapping machine 10, to allow for clearing of excess strapping material and the clearing of any jams that have developed in strapping machine 10.

Although an illustrative embodiment of the invention has been shown and described, it is to be understood that various modifications and substitutions may be made by those skilled in the art without departing from the novel spirit and scope of the invention.

What is claimed is:

1. A strapping machine, allowing easy access to a strap path, comprising:

a strapping head having a strap path;

at least one alignment pin extending outwardly from a face of said head;

a cover, pivotally mounted to said strapping machine, such that in a first closed position, said cover comprises a protective exterior element of said strapping machine and an outer guiding surface for said strap path, and in a second, pivoted open position, sid cover allows access to said strap path, said cover including at least one alignment pin opening cooperating with said at least one alignment pin to position said cover over said strap path when said cover is in said closed position; and a hinge pivotally mounting said cover to said strapping machine at a non-structural member.

2. The strapping machine of claim 1, wherein said strap path comprises a plurality of elements including an accumulator box, a strap gate, a winder, feed wheels and take up wheels.

3. The strapping machine of claim 1, wherein said cover defines a plurality of openings through which properly aligned elements of said strap path may emerge when said cover is pivoted to a closed position.

4. The strapping machine of claim 1, wherein said strapping head includes a pair of alignment pins for cooperating engagement with a pair of openings defined in said cover when said cover is in a first closed position.

5. The strapping machine of claim 1, including an upper strap path having a cover pivotally mounted to said strapping machine, such that in a first closed position, said cover comprises a protective exterior element and guiding surface for said upper strap path and in a second, pivoted open position, said cover allows access to said upper strap path.

6. The strapping machine of claim 1, wherein said non-structural member is a take-up box cover.

7. A strapping machine, allowing easy access to strap paths, comprising:

a strapping head having an upper strap path segment and a lower strap path segment, said strap path segments formed through a number of elements including, a slack box, an accumulator box, a strap gate, a winder, feed wheels and take up wheels;

at least one alignment pin extending outwardly from a face of said strapping head;

a first cover, pivotally mounted to said strapping machine, such that in a first closed position, said first cover comprises a protective exterior element of said strapping machine and an outer guiding surface for said lower strap path segment, and in a second, pivoted open position, said cover allows access to said lower strap path segment, said first cover including at least one alignment pin opening for cooperating engagement with said at least one alignment pin when said first cover is in said first position to align said first cover over said lower strap path segment; and, a second cover, pivotally mounted to said strapping machine, such that in a first closed position said cover comprises a protective exterior element and guiding surface of said upper strap path and in a second, pivoted open position, said cover allows access to said upper strap path.

8. The strapping machine of claim 7, wherein said first cover defines a plurality of openings through which properly aligned elements of said strap path may protrude when said cover is pivoted to a closed position.

9. The strapping machine of claim 7, wherein said strapping head includes a pair of alignment pins for cooperating engagement with a pair of alignment pin openings defined in said first cover when said first cover is in said closed position.

* * * * *